US007398037B2

(12) United States Patent
Choi

(10) Patent No.: US 7,398,037 B2
(45) Date of Patent: Jul. 8, 2008

(54) PROCESS CARTRIDGE USABLE WITH AN IMAGE FORMING APPARATUS AND INCLUDING A SHUTTER

(75) Inventor: Jeong-jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 183 days.

(21) Appl. No.: 11/226,245

(22) Filed: Sep. 15, 2005

(65) Prior Publication Data

US 2006/0062603 A1 Mar. 23, 2006

(30) Foreign Application Priority Data

Sep. 17, 2004 (KR) ..... 10-2004-0074332

(51) Int. Cl.
*G03G 15/08* (2006.01)

(52) U.S. Cl. ..... 399/260; 399/258; 399/262

(58) Field of Classification Search ..... 399/106, 399/111, 113, 114, 119, 120, 258, 260, 262
See application file for complete search history.

(56) References Cited

U.S. PATENT DOCUMENTS 5,828,935 A 10/1998 Totsumi et al.
6,564,029 B2 * 5/2003 Kojima et al. ..... 399/258

FOREIGN PATENT DOCUMENTS

| | | |
|---|---|---|
| JP | 02-79063 | 3/1990 |
| JP | 06-95505 | 4/1994 |
| KR | 1998-42169 | 8/1998 |
| KR | 2000-63032 | 10/2000 |
| KR | 2004-28551 | 4/2004 |

OTHER PUBLICATIONS

Korean Office Action dated Feb. 15, 2006 issued in KR 2004-74332.

* cited by examiner

*Primary Examiner*—Hoang Ngo
(74) *Attorney, Agent, or Firm*—Stanzione & Kim, LLP

(57) ABSTRACT

A process cartridge usable with an image forming apparatus includes a developing cartridge including a toner inlet and a shutter to open and close the toner inlet, and a toner cartridge detachably mounted to the developing cartridge and including a toner supply port to correspond with the toner inlet when connected with the developing cartridge. The shutter may be moved in a direction in which the toner cartridge is connected when the toner cartridge is connected to the developing cartridge, thereby opening the toner inlet, and the shutter may be moved in a direction in which the toner cartridge is detached when the toner cartridge is separated from the developing cartridge, thereby closing the toner inlet. Accordingly, when the toner cartridge is separated from the developing cartridge, the toner inlet of the developing cartridge is closed, thereby preventing leakage of toner through the toner inlet.

31 Claims, 7 Drawing Sheets

PROCESS CARTRIDGE USABLE WITH AN IMAGE FORMING APPARATUS AND INCLUDING A SHUTTER

CROSS-REFERENCE TO RELATED APPLICATIONS

This application claims the benefit of Korean Patent Application No. 2004-74332, filed Sep. 17, 2004, in the Korean Intellectual Property Office, the disclosure of which is incorporated herein in its entirety by reference.

BACKGROUND OF THE INVENTION

1. Field of the Invention

The present general inventive concept relates to an image forming apparatus that uses an electrophotographic process, such as a copy machine and/or a printer. More particularly, the present general inventive concept relates to a process cartridge detachably mounted in the image forming apparatus.

2. Description of the Related Art

A process cartridge is an assembly of a developing unit and a toner unit. The process cartridge includes a photosensitive medium, an electrifying unit, the developing unit, and a cleaning unit integrally formed to be detachably connected with respect to a main assembly of an image forming apparatus.

Electrophotographic image forming apparatuses typically use the process cartridge, since the process cartridge is easily operated and does not require special skills.

The process cartridge comprises a developing cartridge, and a toner cartridge detachably mounted to the developing cartridge to supply a toner to the developing cartridge. FIG. 1 illustrates an image forming apparatus including a main body 1 that uses a process cartridge 10.

As illustrated in FIG. 1, the main body 1 has a cartridge seating portion 2 for mounting the process cartridge 10 therein. The process cartridge 10 comprises a developing cartridge 20 and a toner cartridge 30. The toner cartridge 30 and the developing cartridge 20 are illustrated separately in FIGS. 2A and 2B, respectively. FIG. 3 illustrates both the toner cartridge 30 and the developing cartridge 20 detachably mounted to each other as the process cartridge 10.

The developing cartridge 20 comprises a developing cartridge frame 21 having a toner inlet 21*a*. Other developing parts of the developing cartridge 20, such as a photosensitive medium rotatably mounted to the cartridge frame 21, are omitted from the figures.

The toner cartridge 30 comprises a toner cartridge frame 31 having a toner supply port 31*a*. The toner cartridge 30 comprises additional parts such as an agitator for agitating the toner stored in a toner chamber formed therein and for moving the toner toward the toner supply port 31*a*. However, these additional parts are also omitted from the figures.

As illustrated in FIG. 3, the developing cartridge 20 and the toner cartridge 30 are detachably mounted to each other. The toner can be supplied by connecting the toner inlet 21*a* of the developing cartridge 20 to the toner supply port 31*a* of the toner cartridge 30 to correspond with each other.

The developing cartridge 20 and the toner cartridge 30 can be respectively mounted to the main body 1 of the image forming apparatus such that only the toner cartridge 30 need be replaced when the toner is used up. The toner inlet 21*a* of the developing cartridge 20 is initially blocked by a removable packaging lid, such as a plastic film, but is opened for use by removing the packaging lid. As a result, the toner inlet 21*a* is left open during and between uses of the image forming apparatus. When the toner inlet 21*a* is connected with the toner cartridge 30, a sponge seal attached around the toner inlet 21*a* is able to prevent the toner from leaking from the developing cartridge 20.

However, when the toner cartridge 30 is disconnected from the developing cartridge 20 (e.g., in a state that the process cartridge 10 is removed from the main body 1), the toner in the developing cartridge 20 may leak through the toner inlet 21*a*, which is in an open state. The leakage of the toner may lower the density of an image, and deteriorate image quality. Therefore, preventing the toner leakage from the developing cartridge 20 is necessary in order to improve the image quality.

SUMMARY OF THE INVENTION

The present general inventive concept provides a process cartridge of an image forming apparatus that is capable of preventing leakage of toner through a toner inlet by automatically closing the toner inlet when a toner cartridge is separated from a developing cartridge.

The present general inventive concept also provides a process cartridge of an image forming apparatus having a toner inlet opening/closing unit to automatically open and close the toner inlet in association with mounting and dismounting of a toner cartridge with respect to a developing cartridge.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a process cartridge comprising a developing cartridge including a toner inlet, a toner cartridge detachably mounted to the developing cartridge and including a toner supply port to correspond with the toner inlet when being connected with the developing cartridge, and a toner inlet opening/closing unit operated in association with mounting and dismounting of the toner cartridge with respect to the developing cartridge and including a shutter to open and close the toner inlet.

The toner inlet opening/closing unit may comprise the shutter mounted on the developing cartridge to move between a first and second position to open and close the toner inlet, respectively, an operation piece projecting from the shuttle, a resilient member to resiliently support the shutter toward the second position; and a driving rib mounted to the toner cartridge to contact the operation piece when the toner cartridge is connected.

The process cartridge may further comprise a pair of guide rails formed on both sides of the toner inlet of the developing cartridge to guide the movement of the shutter, a sliding hole formed adjacent to the toner inlet to receive the operation piece of the shutter, and a first boss formed at one end of the sliding hole to support the resilient member.

A first end of the resilient member can be supported by the first boss and a second end of the resilient member can be formed by a compressing coil spring supported by a second boss formed on the shutter.

The process cartridge may further comprise a sealing member mounted around the sliding hole in order to prevent the toner in the developing cartridge from leaking through the sliding hole.

The sliding hole of the developing cartridge can have a pair of fixing ribs on both sides thereof, and the sealing member can have a pair of fixing projections corresponding with the fixing ribs on both sides thereof, such that the sealing member is mounted over the sliding hole in a sliding manner.

The sealing member can comprise a receiving groove to receive the resilient member along a lengthwise direction thereof and a dodge groove to seal an end of the sealing member through which the shutter moves.

The foregoing and/or other aspects and advantages of the present general inventive concept are also achieved by providing a process cartridge of an image forming apparatus, which comprises a developing cartridge including a toner inlet and a shutter to open and close the toner inlet, and a toner cartridge detachably mounted to the developing cartridge and including a toner supply port to correspond with the toner inlet when connected with the developing cartridge. The shutter can be moved in a direction in which the toner cartridge is moved when being connected to the developing cartridge, thereby opening the toner inlet, and the shutter can be moved in a direction in which the toner cartridge is moved when being separated from the developing cartridge, thereby closing the toner inlet.

The shutter can include an opening/closing part and an operation piece perpendicularly bent from the opening/closing part, and the toner cartridge can include a driving rib to contact the operation piece when being connected to the developing cartridge. The opening/closing part can further comprise a resilient member to move the shutter to a position to close the toner inlet when the toner cartridge is separated from the developing cartridge.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
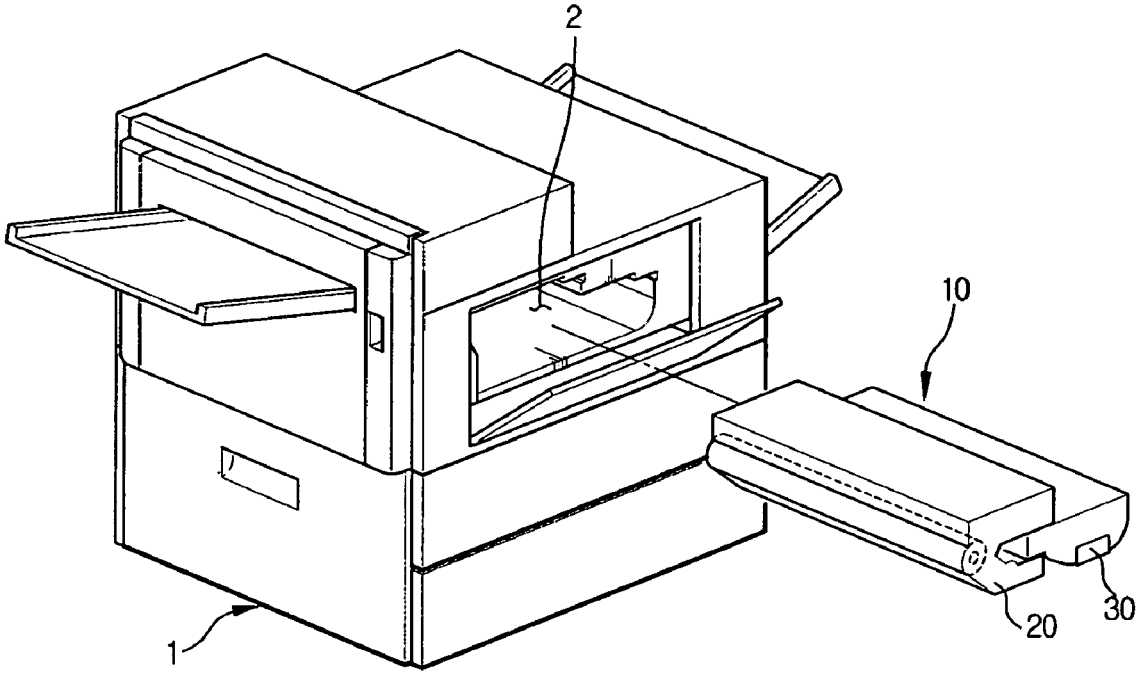
FIG. 1 (PRIOR ART)
FIG. 1 illustrates generally an image forming apparatus that uses a process cartridge.
Figure 2A:
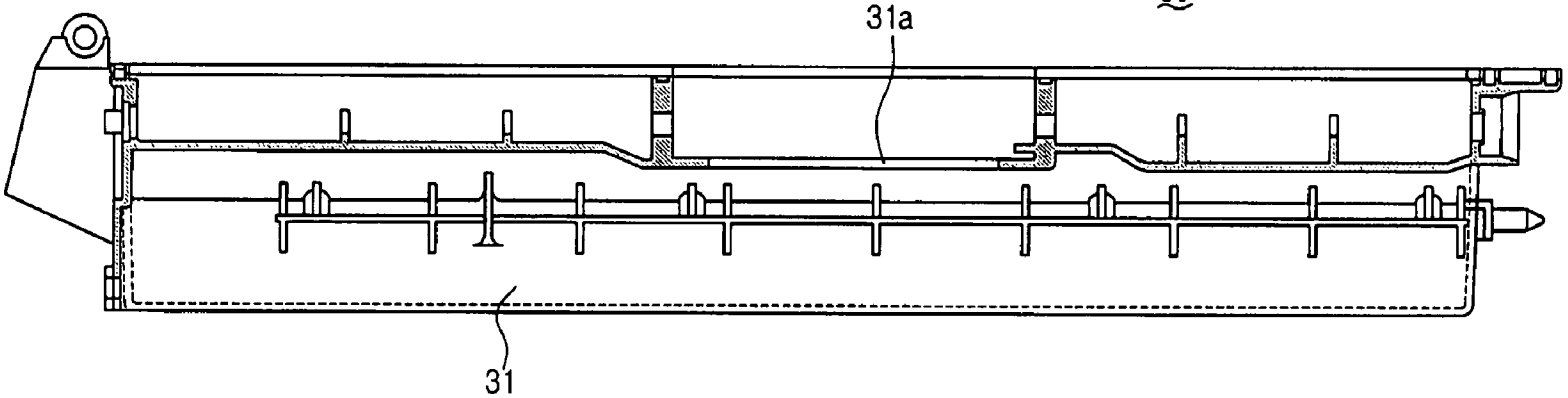
FIG. 2A (PRIOR ART)
FIGS. 2A and 2B illustrate a toner cartridge and a developing cartridge, respectively, of the process cartridge of FIG. 1.
Figure 2B:
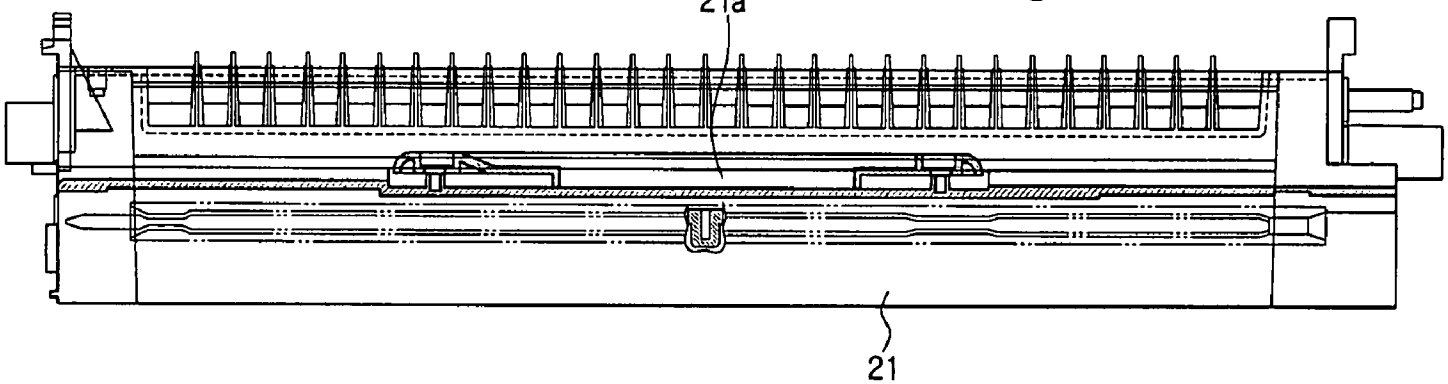
FIG. 2B (PRIOR ART)
Figure 3:
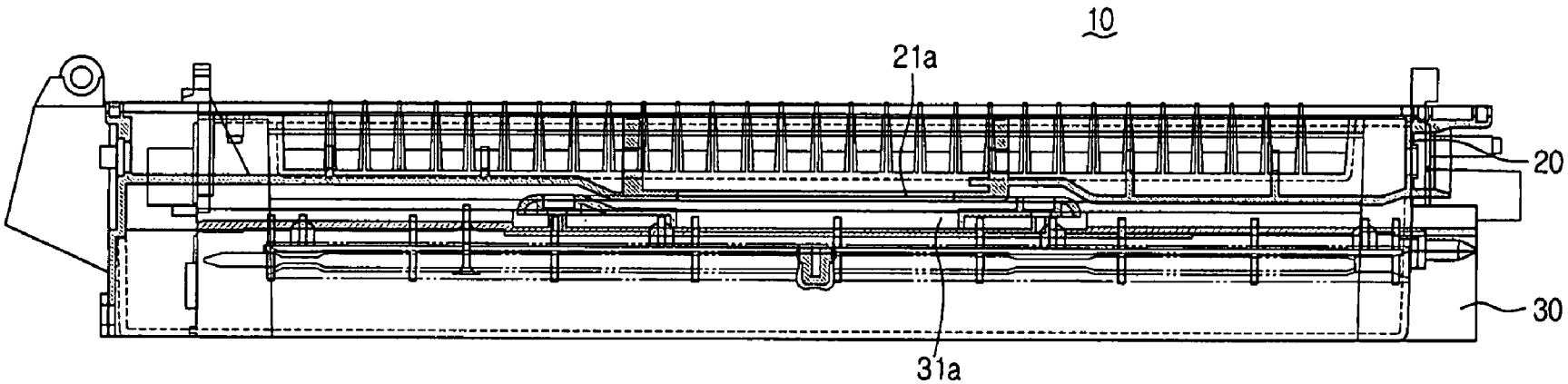
FIG. 3 (PRIOR ART)
FIG. 3 illustrates the toner cartridge and the developing cartridge of FIG. 2 connected to each other as the process cartridge of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 5:
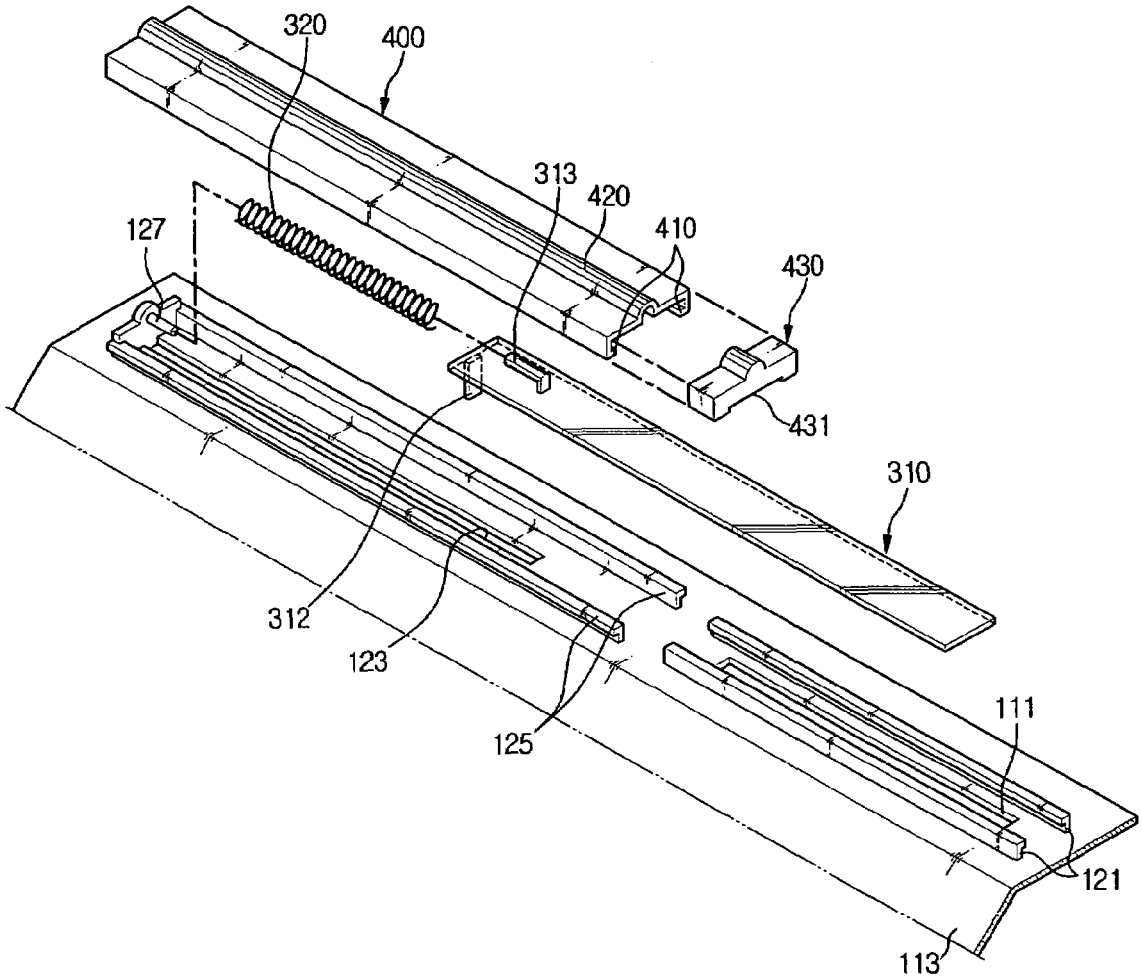
FIG. 5 is an exploded perspective view illustrating the toner inlet opening/closing unit of FIG. 4.
Figure 6:
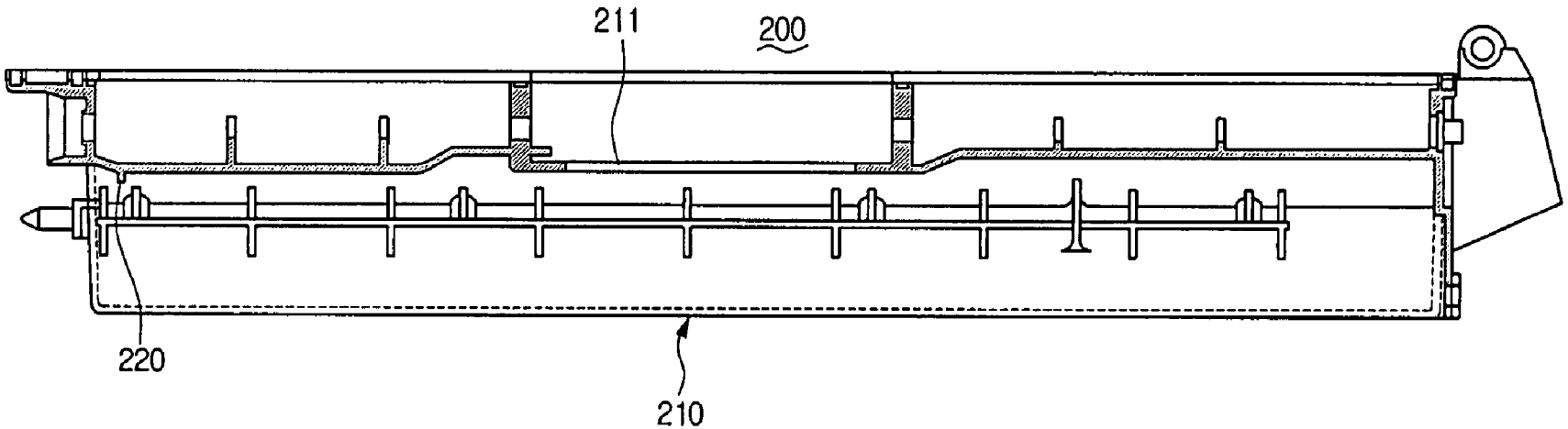
FIG. 6 illustrates a toner cartridge of a process cartridge according to an embodiment of the present general inventive concept.
Figure 7:
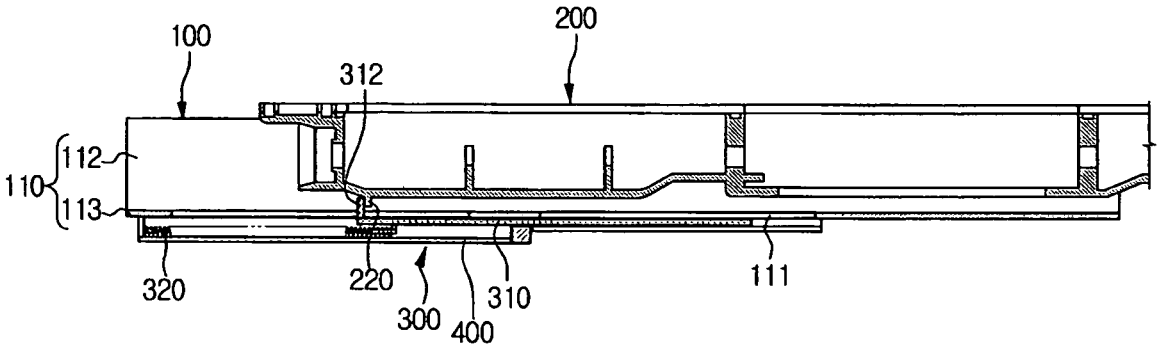
FIG. 7 illustrates a shutter when the toner cartridge of FIG. 6 is connected to a developing cartridge in the process cartridge according to an embodiment of the present general inventive concept.

FIGS. 4A through 7 are views illustrating a process cartridge according to an embodiment of the present general inventive concept. As illustrated in FIG. 7, the process cartridge includes a developing cartridge 100, a toner cartridge 200, and a toner inlet opening/closing unit 300.

As illustrated in FIGS. 5 and 7, the developing cartridge 100 comprises a developing cartridge frame 110 having a toner inlet 111. The developing cartridge frame 110 comprises a frame body 112 and a frame cover 113. The toner inlet 111 is disposed substantially at the center of the frame cover 113. Although not specifically shown, the developing cartridge 100 may comprise one or more of a photosensitive medium, a developing roller, a toner supplying roller, an electrifying roller, and a cleaning member. Other components may also be included in the developing cartridge 100.

As illustrated in FIG. 5, the frame cover 113 comprises a pair of guide rails 121, a sliding hole 123, a pair of fixing ribs 125, and a first boss 127 disposed thereon between the fixing ribs 125 to operate and install parts of the toner inlet opening/closing unit 300. The guide rails 121 are disposed on both sides of the toner inlet 111 in a lengthwise direction of the toner inlet 111 at the center of the frame cover 113. The sliding hole 123 is formed adjacent to the toner inlet 111 on one end of the frame cover 113 (on the left in FIG. 5), and the fixing ribs 125 are disposed on both sides of the sliding hole 123. The first boss 127 is disposed at one end the sliding hole 123.

As illustrated in FIG. 7, the toner cartridge 200 is detachably mounted to the developing cartridge 100. Referring to FIG. 6, the toner cartridge 200 comprises a toner cartridge frame 210 having a toner supply port 211 which corresponds with the toner inlet 111 when the toner cartridge 200 is connected to the developing cartridge 100. Although not shown, the toner cartridge 200 may further comprise an agitator to agitate the toner stored therein and to move the toner toward the toner supply port 211.

The toner inlet opening/closing unit 300 is operated in association with mounting and dismounting of the toner cartridge 200 with respect to the developing cartridge 100, thereby opening and closing the toner inlet 111.

As illustrated in FIG. 7, the toner inlet opening/closing unit 300 comprises a shutter 310, a resilient member 320 and the driving rib 220 mounted to the toner cartridge 200.

Figure 4A:
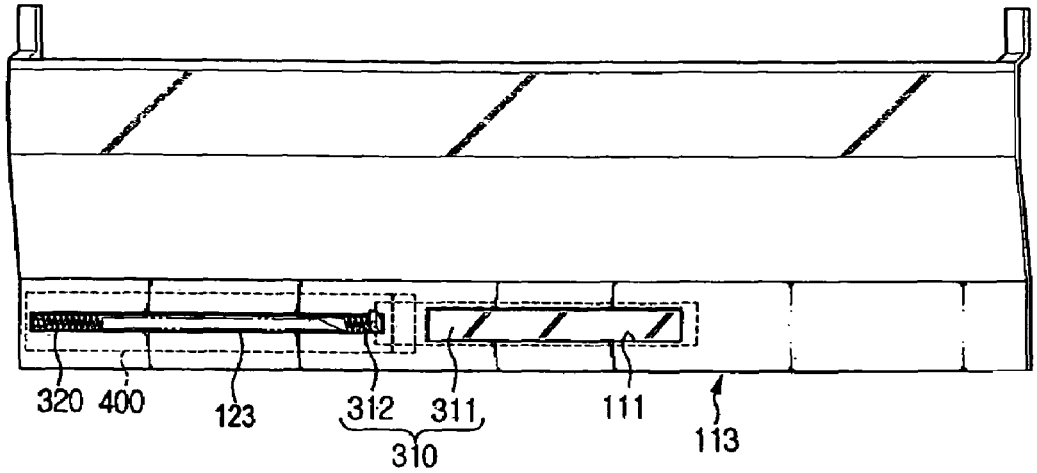
FIGS. 4A and 4B illustrate structure and operation of a toner inlet opening/closing unit of a process cartridge according to an embodiment of the present general inventive concept.
Figure 4B:
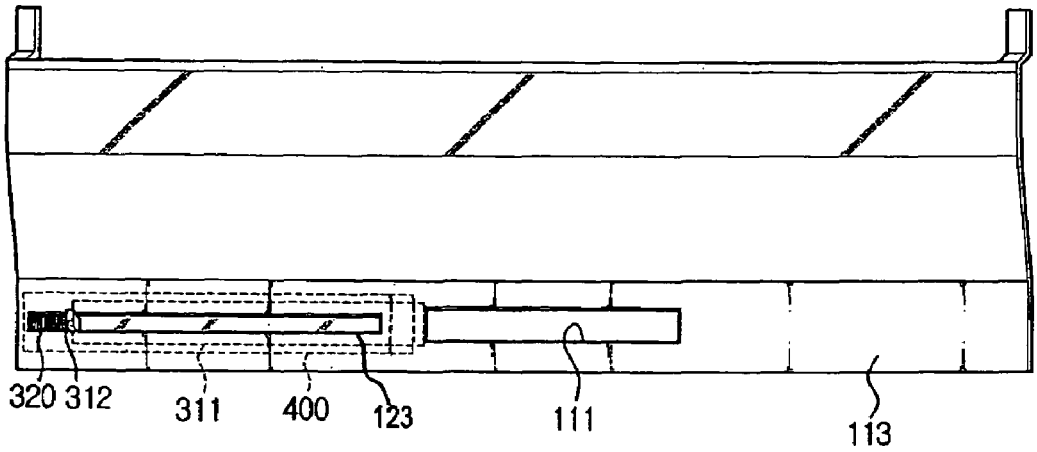

Referring to FIGS. 4A, 4B and 5, the shutter 310 is disposed at the frame cover 113 of the developing cartridge 100 to move between a first and a second position where the toner inlet 111 is opened and closed, respectively. The shutter 310 includes an opening/closing part 311 formed as a flat piece having a predetermined height, width, and length, and an operation piece 312 bent perpendicularly from the opening/closing part 311. As illustrated in FIG. 5, the shutter 310 is supported by the pair of guide rails 121. The guide rails 121 disposed on both sides of the toner inlet 111 form an open slit in conjunction with the frame cover 113 to receive the opening/closing part 311 of the shutter 310 as the operation piece 312 is received in the sliding hole 123. The open slit provided by the guide rails 121 forms a track along the toner inlet 111 along which the opening/closing part 311 of the shutter 310 is moved during operation (i.e., detaching and attaching the toner cartridge 200).

Referring to FIGS. 4A, 4B, 6 and 7, as the operation piece 312 (FIGS. 4A, 4B and 7) protrudes through the sliding hole 123 (see, for example, FIG. 4A), the driving rib 220 (FIG. 7) of the toner cartridge 200 comes into contact with the operation piece 312 as the toner cartridge 200 is being connected to the developing cartridge 100. Accordingly, the shutter 310 moves in a direction in which the toner cartridge 200 is moved when being connected to the developing cartridge 100, thereby opening the toner inlet 111 of the developing cartridge 100.

As illustrated in FIG. 5, the opening/closing part 311 of the shutter 310 has a second boss 313 corresponding with the first boss 127 through the resilient member 320, which is disposed therebetween. The resilient member 320 is disposed between the first and the second bosses 127 and 313 and resiliently biases the shutter 310 toward the second position to close the toner inlet 111 (when the toner cartridge 200 is not connected to the developing cartridge 100). The resilient member 320 may comprise a coil spring. However, other types of resilient members may also be used to support the shutter 310 toward the second position.

As illustrated in FIGS. 4A, 5 and 7, the process cartridge according to the present embodiment further comprises a sealing member 400 provided around the sliding hole 123 in order to prevent the toner in the developing cartridge 100 from leaking through the sliding hole 123.

Referring to FIG. 5, the sealing member 400 has a pair of fixing projections 410 to insert into the pair of fixing ribs 125 formed on both sides of the sliding hole 123 in a lengthwise direction to be facilely mounted with respect to the frame cover 113 in a sliding manner. In addition, the sealing member 400 includes a receiving groove 420 disposed substantially at the center thereof in a lengthwise direction of the resilient member 320 to receive the resilient member 320 and to allow the resilient member 320 to move freely between the fixing ribs 125. Furthermore, the sealing member 400 includes a second sealing member 430 having a dodge groove 431 to seal an end of the sealing member 400. The dodge groove 431 has a height that corresponds with the predetermined height of the opening/closing part 311 of the shutter 310 to allow the opening/closing part 311 to move therethrough.

Hereinbelow, the operation of the toner inlet opening/closing unit 300 of the process cartridge according to an embodiment of the present general inventive concept will be described with reference to FIGS. 4A, 4B and 7.

FIG. 4A illustrates the toner inlet 111 of the developing cartridge 100 being closed by the shutter 310 (i.e., moving into the second position) as the toner cartridge 200 is separated from the developing cartridge 100. The shutter 310 is moved into the second position by a recovery force of the resilient member 320, and therefore, the toner inlet 111 becomes closed. As a result, although the toner cartridge 200 is separated from the developing cartridge 100 when the process cartridge is detached from a main body of an image forming apparatus (e.g., for maintenance or repair), the toner inlet 111 can be maintained in a closed state. Accordingly, leakage of the toner through the toner inlet 111 can be prevented, and handling of the process cartridge becomes easy and convenient.

FIG. 4B illustrates the toner inlet 111 in an opened state as the shutter 310 is moved to the first position and the toner cartridge 200 is connected to the developing cartridge 100. FIG. 7 illustrates the operation of the shutter 310 when the toner cartridge 200 is connected with respect to the developing cartridge 100.

As illustrated in FIG. 7, when the toner cartridge 200 is connected to the developing cartridge 100, the driving rib 220 of the toner cartridge 200 contacts the operation piece 312 of the shutter 310, thereby moving the shutter 310 in the direction in which the toner cartridge 200 is being connected to the developing cartridge 100. Accordingly, the toner inlet 111 of the developing cartridge 100 becomes opened. Here, the resilient member 320 is in a compressed state.

When the toner cartridge 200 is separated from the developing cartridge 100, the driving rib 220 and the operation piece 312 are released from each other. The shutter 310 is then moved to the second position by the recovery force of the resilient member 320, and accordingly, the toner inlet 111 of the developing cartridge 100 becomes closed by the shutter 310, as illustrated in FIG. 4A.

As can be appreciated from the above description, as a toner cartridge is separated from a process cartridge, which is withdrawn from a main body of an image forming apparatus, a toner inlet of a developing cartridge is automatically closed, thereby preventing leakage of toner through the toner inlet. As a result, degradation of image quality caused by the toner leakage can be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A process cartridge of an image forming apparatus, comprising:

a developing cartridge including a toner inlet;

a toner cartridge detachably mountable to the developing cartridge and including a toner supply port to correspond with the toner inlet when being mounted with the developing cartridge;

a toner inlet opening/closing unit to operate in association with the mounting and dismounting of the toner cartridge with respect to the developing cartridge and including a shutter to open and close the toner inlet; and a sliding hole formed on the developing cartridge adjacent to the toner inlet to receive an operation piece projecting from the shutter.

2. The process cartridge of claim 1, wherein the toner inlet opening/closing unit comprises:

the shutter mounted on the developing cartridge to move between a first position and a second position to open and close the toner inlet, respectively;

a resilient member to resiliently support the shutter toward the second position; and a driving rib mounted to the toner cartridge to contact the operation piece when the toner cartridge is mounted to the developing cartridge.

3. The process cartridge of claim 2, further comprising:

a pair of guide rails formed on both sides of the toner inlet of the developing cartridge to guide the movement of the shutter; and a first boss formed at one end of the sliding hole to support the resilient member.

4. The process cartridge of claim 3, wherein a first end of the resilient member is supported by the first boss and a second end of the resilient member is formed by a compressing coil spring supported by a second boss formed on the shutter.

5. The process cartridge of claim 4, further comprising:

a sealing member mounted around the sliding hole to prevent the toner in the developing cartridge from leaking through the sliding hole.

6. The process cartridge of claim 5, wherein the sliding hole of the developing cartridge has a pair of fixing ribs on both sides thereof, and the sealing member has a pair of fixing projections corresponding with the fixing ribs on both sides thereof, such that the sealing member is mounted over the sliding hole in a sliding manner.

7. The process cartridge of claim 6, wherein the sealing member comprises a receiving groove to receive the resilient member along a lengthwise direction thereof and a dodge groove to seal an end of the sealing member through which the shutter moves.

8. A process cartridge of an image forming apparatus, comprising:

a developing cartridge including a toner inlet and a shutter to open and close the toner inlet;

a toner cartridge detachably mountable to the developing cartridge and including a toner supply port to correspond with the toner inlet when the toner cartridge is mounted with the developing cartridge, wherein the shutter moves in a direction in which the toner cartridge moves when being connected to the developing cartridge, thereby opening the toner inlet, and the shutter moves in a direction in which the toner cartridge moves when being separated from the developing cartridge, thereby closing the toner inlet; and a sliding hole formed adjacent to the toner inlet to receive an operation piece projecting from the shutter.

9. The process cartridge of claim 8, wherein the shutter comprises an opening/closing part and the operation piece is perpendicularly bent from the opening/closing part, and the toner cartridge further includes a driving rib to contact the operation piece when being connected to the developing cartridge.

10. The process cartridge of claim 8, further comprising:

a resilient member to move the shutter to a position to close the toner inlet when the toner cartridge is separated from the developing cartridge.

11. A process cartridge usable with an image forming apparatus, comprising:

a first cartridge having a first port;

a second cartridge attachable to the first cartridge and having a second port to correspond with the first port of the first cartridge when attached thereto;

a port control part to open the first port of the first cartridge when the second cartridge is attached thereto and to close the first port of the first cartridge when the second cartridge is detached therefrom;

a sliding hole disposed adjacent to the first port on the first cartridge;

a shutter movable along a surface of the first cartridge between a first position away from the first port and a second position to close the first port; and an operation piece protecting from the shutter and extending through the first cartridge sliding hole and to contact a driving part of the second cartridge when the second cartridge is attached to the first cartridge.

12. The process cartridge of claim 11, wherein the first cartridge comprises a developing cartridge, the first port comprises a toner inlet port, the second cartridge comprises a toner cartridge, and the second port comprises a toner supply port.

13. The process cartridge of claim 11, wherein the port control part is disposed on an inside surface of the first cartridge and comprises:

a shutter driver to drive the movable shutter between the first position and the second position.

14. The process cartridge of claim 13, wherein the second cartridge comprises a driving rib that operates the shutter driver to move the shutter into the first position as the second cartridge is being attached to the first cartridge and operates the shutter driver to move the shutter into the second position as the second cartridge is being detached from the first cartridge.

15. The process cartridge of claim 13, wherein the shutter driver comprises:

a resilient member to exert a first bias force on the shutter to bias the shutter toward the second position; and a second cartridge driving part to provide a second bias force to the shutter opposite to the first bias force to bias the shutter toward the first position when the second cartridge is being attached to the first cartridge.

16. The process cartridge of claim 15, wherein the resilient member comprises:

a spring disposed along the sliding hole;

a first boss disposed on the inside surface of the first cartridge adjacent to an end of the sliding hole opposite to the first port to contact the spring at a first end thereof; and a second boss projecting from the shutter in a direction opposite to the operation piece to contact the spring at a second end thereof.

17. The process cartridge of claim 15, wherein the first cartridge further comprises a sealing part to seal the sliding hole on the first cartridge, the sealing part comprising:

a pair of fixing ribs disposed along each side of the sliding hole, and a sealing member to be disposed over the sliding hole and having fixing projections to couple with the pair of fixing ribs such that the sealing member is disposed over the sliding hole in a sliding manner.

18. The process cartridge of claim 17, wherein the sealing part further comprises:

a receiving groove to correspond with the sliding hole and to receive the resilient member and to enable the resilient member to move along the receiving groove.

19. The process cartridge of claim 18, wherein the sealing part further comprises:

a dodge groove part disposed at an end of the sliding hole adjacent to the first port and having a slit of a predetermined height that corresponds to a thickness of the shutter such that the shutter is movable therethrough.

20. The process cartridge of claim 13, wherein the first cartridge further comprises:

a pair of guide rails disposed along each side of the first port along the inside surface of the first cartridge to form a track along which the shutter is movable over the first port.

21. A method of preventing leakage from a toner inlet port in a developing cartridge of a process cartridge, the method comprising:

biasing a shutter disposed along an inner surface of the developing cartridge to block the toner inlet port when a toner cartridge is not connected thereto; and applying a connection force from the toner cartridge to an operation piece extending from the shutter to guide the shutter along a sliding hole of the developing cartridge and to oppose the biasing of the shutter and to move the shutter away from the toner inlet port as the toner cartridge is connected to the developing cartridge.

22. The method of claim 21, wherein the biasing of the shutter is performed by a spring disposed adjacent to the shutter along the inner surface of the developing cartridge.

23. The method of claim 22, wherein the applying of the connection force comprises:

transferring the connection force to the spring to compress the spring, thereby moving the shutter away from the toner inlet port.

24. The method of claim 22, further comprising: sealing the sliding hole to prevent toner in the developing cartridge from leaking through the sliding hole.

25. A process cartridge usable with an image forming apparatus, comprising:

a first cartridge having a first opening and a shutter to cover the first opening;

a second cartridge having a second opening near the opening of the first cartridge when coupled to the first cartridge; and a sliding hole disposed on the first cartridge adjacent to the first opening to receive and to guide therein an operation piece which extends from the shutter, wherein the second cartridge biases the shutter to move the shutter operation piece along the sliding hole to uncover the opening when the second cartridge is coupled to the first cartridge and allows the shutter to move the shutter operation piece along the sliding hole to cover the opening when uncoupled therefrom.

26. The process cartridge of claim 25, wherein the first cartridge comprises a developing cartridge, the first opening comprises a toner inlet port, the second cartridge comprises a toner cartridge, and the second opening comprises a toner supply port.

27. The process cartridge of claim 25, wherein the shutter comprises an opening/closing part and the operation piece is perpendicularly bent from the opening/closing part.

28. The process cartridge of claim 27, wherein the second cartridge comprises a biasing member to bias the shutter.

29. The process cartridge of claim 28, wherein the second cartridge biasing member comprises a driving rib to contact the operation piece when being coupled to the first cartridge.

30. The process cartridge of claim 25, wherein the first cartridge further includes a resilient member to move the shutter to a position to close the first opening when the second cartridge is separated from the first cartridge.

31. The process cartridge of claim 30, wherein the resilient member is a spring.

* * * * *